US005816175A

United States Patent [19]

Teramoto

[11] Patent Number: 5,816,175

[45] Date of Patent: Oct. 6, 1998

[54] THREAD CONTROL APPARATUS FOR A DOUBLE CHAIN STITCH SEWING MACHINE

[75] Inventor: Masashi Teramoto, Osaka, Japan

[73] Assignee: Pegasus Sewing Machine Mfg. Co., Ltd., Osaka, Japan

[21] Appl. No.: 837,011

[22] Filed: Apr. 11, 1997

[30] Foreign Application Priority Data

Apr. 19, 1996 [JP] Japan ..... 8-122663

[51] Int. Cl.[6] ..... D05B 1/10; D05B 47/04; D05B 49/00

[52] U.S. Cl. ..... 112/165; 112/241; 112/254

[58] Field of Search ..... 112/165, 166, 112/254, 255, 197, 199, 201, 202

[56] References Cited

U.S. PATENT DOCUMENTS 5,315,945 5/1994 Nakano ..... 112/255
5,398,627 3/1995 Nishikawa ..... 112/165 X
5,495,816 3/1996 Sanvito et al. ..... 112/165
5,513,587 5/1996 Takada et al. ..... 112/254 X

*Primary Examiner*—Peter Nerbun
*Attorney, Agent, or Firm*—Jones, Tullar & Cooper, P.C.

[57] ABSTRACT

A thread control apparatus for a double chain stitch sewing machine of the present invention is applied to the case of sewing a cloth with a double chain stitch sewing machine having multiple needles, and forming a thread chain consecutively to the sewing end of the cloth. Two thread tensioning devices change over and apply mutually different thread tensions to needle threads and to a looper thread passed through a plurality of needles and a looper, respectively, when sewing the cloth and when forming a thread chain. An other looper thread tensioning device disposed in a thread route between a looper thread take-up device and the looper. The other looper thread tensioning device limits the draw-out amount of thread by pinching the looper thread from the looper thread take-up device to the looper side only when forming a thread chain, and therefore a tight thread chain may be securely formed when forming a thread chain. As such, the thread chain can be drawn out securely and stably even in high speed operation of the sewing machine.

6 Claims, 4 Drawing Sheets

THREAD CONTROL APPARATUS FOR A DOUBLE CHAIN STITCH SEWING MACHINE

BACKGROUND OF THE INVENTION

1. Field of the Invention

The present invention relates to a thread control apparatus mainly applied to the sewing of cloth by a double chain stitch sewing machine using two needles or three needles, and more particularly to a thread control apparatus designed to change over the thread tensioning when forming a thread chain successively at a cloth end, after sewing a cloth by a double chain stitch sewing machine, the machine comprising a plurality of needles disposed right and left and a looper for forming a double chain stitch in cooperation with the needles by oscillating right and left from the right side of these needles.

2. Description of the Prior Art

In sewing of cloth by a double chain stitch sewing machine of this kind, productivity can be enhanced by continuing the sewing operation consecutively by feeding a new cloth successively, without stopping the drive of the sewing machine when reaching the sewing end of one cloth.

As shown in FIG. 6, in the double chain stitch sewing machine 5 used in such sewing work, two needles 2, 3 disposed in parallel right and left to the lower end of a needle bar 1 are attached to the needle bar 1 by setting the position so that the right needle 3 may be higher than the left needle 2. A looper 4 oscillating laterally from the right side of these two needles 2, 3 is provided, and it is constituted so that a double chain stitch may be formed by cooperation of these needles 2, 3 and looper 4. By the thus constituted double chain stitch sewing machine 5, when a double chain stitch, without a cover thread on the cloth, for example, a U.S. Federal Standard stitch type 402, 406 or 407 is formed, since this stitch has no cover thread, the thread chain linked between the sewing end of the cloth and the stitch formed in the cloth fed next cannot be supported by the tongue of a needle plate 6. Therefore, the thread chain C consecutive to the sewing end of a cloth a falls into a needle hole 6*a* (see FIG. 2) formed so as to trim the tongue when the needles 2, 3 are lowered, and the thread chain C cannot receive the action of a feed dog 13 for drawing out the thread chain. This leads to problems of jamming or breakage of thread the chain C near the lowest position of the needles 2, 3, so that continuous sewing is interrupted.

In order to support the thread chain C to prevent it from falling into the needle hole when the thread chain is formed by such a double chain stitch sewing machine, or to draw out the thread chain securely, as disclosed in, for example, Japanese Laid-open Patent 5-300991 (corresponding to U.S. Pat. No. 5,398,627), Japanese Laid-open Patent 6-182079, Japanese Laid-open Patent 7-8667, or Japanese Laid-open Patent 7-275546 (corresponding to U.S. Pat. No. 5,513,587), it has been proposed to modify the structure or function of the needle plate 6, feed dog 13, presser foot 14, etc. These apparatus, as shown in FIG. 6, comprise a sensor 7 for detecting the presence or absence of cloth, a thread tensioning device 8A for applying a thread tension to right and left needle threads 10, 11 and a looper thread 12 passed respectively through the needles 2, 3 and the looper 4 when sewing using a specified double chain stitch, a thread tensioning device 8B for applying a thread tension different from the thread tension applied to the threads 10, 11 and 12 by the thread tensioning device 8A when forming a thread chain, and a thread tensioning changeover device 9 for changing over the thread tensioning action state by the thread tensioning devices 8A, 8B, and a when the sewing end of the cloth is detected, by the sensor 7. A the end of sewing of a specified double chain stitch, the thread tensioning changeover device 9 is put in action to automatically change over the state of applying thread tension to the threads 10, 11 and 12, that is, from the thread tensioning state by the thread tensioning device 8A to the thread tensioning state by the thread tensioning device 8B, and in addition one of the apparatus is designed to control the needle threads 10, 11 by a special thread take-up cam.

In the apparatus disclosed in the above publications, however, since the thread tension is controlled by the two thread tensioning devices 8A, 8B disposed at the thread feed source side, rather than the thread take-up device 24 for needle thread and thread take-up device 15 for a looper thread, it is difficult to finely and adequately control thread tension. Moreover, when the sewing machine is operated at a high speed of over 5,000 rpm, the looper thread may be disturbed, and hence forming a thread chain may be unstable, or the action of drawing out the thread chain by the feed dog may be inaccurate.

Referring to FIG. 7 which shows the state of engagement between the needles 2, 3, looper 4 and looper thread 12 in the thread chain forming process, when the right needle thread 11 is pulled to the left needle thread 10 side in the ascending stroke of the needles 2, 3, as the right needle 3 descends, the right needle 3 descends to, the outside of a triangle of the thread formed by the right needle thread 11 and looper thread 12, that is, to the right side of the right needle thread 11, and a loop 11*a* is formed close to a double chain stitch by the left needle thread, and part of the thread chain makes a skipped stitch formation, so that the thread chain can be easily drawn out in block. As shown in FIG. 8, however, when the looper 4 advances to the left side, the right needle 3 ascends, and the looper thread 12 is dislocated from the right needle 3 to form a sag 12*a*, the right needle thread 11 cannot be pulled securely to the left needle thread 10 side.

That is, the looper thread 12 in the loosened state by the thread take-up device 15 when forming a thread chain tends to be drawn out to the left from the thread take-up device 15 along with the leftward advancement of the looper 4, and therefore if it is set to apply a strong tension to the looper thread 12 by the thread tensioning device 8B, it is impossible to absorb all the sag 12*a* occurring in the looper thread 12, and sag is left over in part inevitably. As a result, the thread chain is not formed neatly, and stays in a state incapable of receiving securely the drawing-out action backward by the feed dog. This causes breakage of the thread chain or jamming of the thread chain.

Yet, when the loop 11*a* of the right needle thread 11 in the loosened state droops between the feed dog and right needle 3, and the looper 4 advances to the left side, the looper 4 captures the drooping loop 11*a*, which is in a so-called double captured state, and it also leads to the problem of breakage of the thread chain.

SUMMARY OF THE INVENTION

It is an object of the present invention to provide a thread control apparatus for a double chain stitch sewing machine capable of forming a tight thread chain securely and also drawing out the thread chain stably in high speed operation of the sewing machine, by adequately keeping the tension of the looper thread when, forming a thread chain, in sewing by a double chain stitch without a cover thread.

To achieve this object, the thread control apparatus for a double chain stitch sewing machine comprises a plurality of needles disposed parallel right and left to the lower end of a needle bar, a looper oscillating laterally from the right side of the parallel direction of the plurality of needles, two thread tensioning devices for applying different thread tensions to a plurality of needle threads and a looper thread respectively passed through the plurality of needles and the looper when sewing cloth and when forming a thread chain, a needle thread take-up device and a looper thread take-up device being disposed between the two thread tensioning devices and the needles and looper, a sensor for detecting the presence or absence of cloth, a thread tensioning changeover device for automatically changing over the thread tension applied to the plurality of needle threads and looper thread by the two thread tensioning devices depending on the result of detection of the presence or absence of cloth by the sensor, an other looper thread tensioning device disposed in the thread route between the looper and the looper thread take-up device for applying a tension to the looper thread from the thread take-up device side to the looper side, and a releasing device for releasing the looper thread tensioning action by the other looper thread tensioning device when sewing cloth.

According to the present invention having such features, as nearing the end of sewing to form a double chain stitch in a cloth by cooperation of the plurality of needles and the looper, the thread tensioning changeover device is actuated by receiving a detection signal from the sensor, the two thread tensioning devices are automatically changed over from a thread tension in the cloth, sewing in a state of strong tension applied to the plurality of needle threads and a weak tension applied to the looper thread, to a thread tension in the thread chain forming in a state of weak tension applied to the right needle thread and strong tension applied to the looper thread, and, at the same time, the other looper thread tensioning device disposed in the thread route between the looper and the looper thread take-up device controls the draw-out amount of the looper thread in the leftward movement of the looper by pinching the looper thread in the loose state by the looper thread take-up device. Accordingly, while moving the right needle thread loop to the left of the right side needle of the plurality of needles when forming a chain stitch, the sag of the looper thread temporarily occurring in this movement is not only absorbed by the leftward movement of the looper, but also the right side needle thread in the loose state can be securely pulled to the left side needle thread, and the tension of the looper thread when forming a thread chain can be kept in a proper controlled state, so that it is effective to form a tight thread chain securely in high speed operation of the sewing machine, and draw it out stably by the feed dog.

Other objects and effects of the present invention will be better understood from the detailed description of the embodiments disclosed below.

PREFERRED EMBODIMENT OF THE INVENTION

Figure 1:
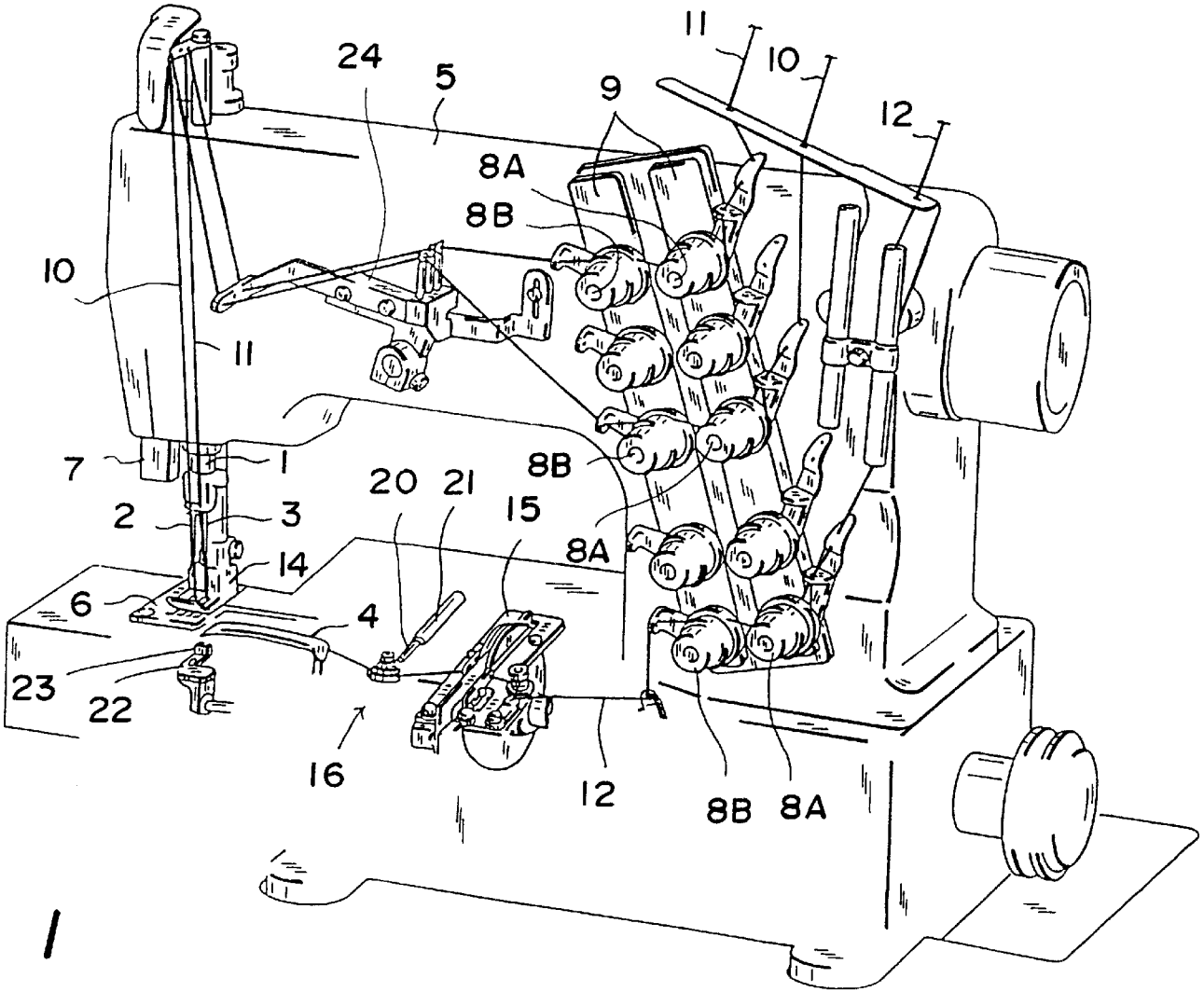
FIG. 1 is a perspective view showing of a double chain stitch sewing machine according to the present invention.

Referring now to the drawings, an embodiment of the present invention is described in detail below.

Figure 6:
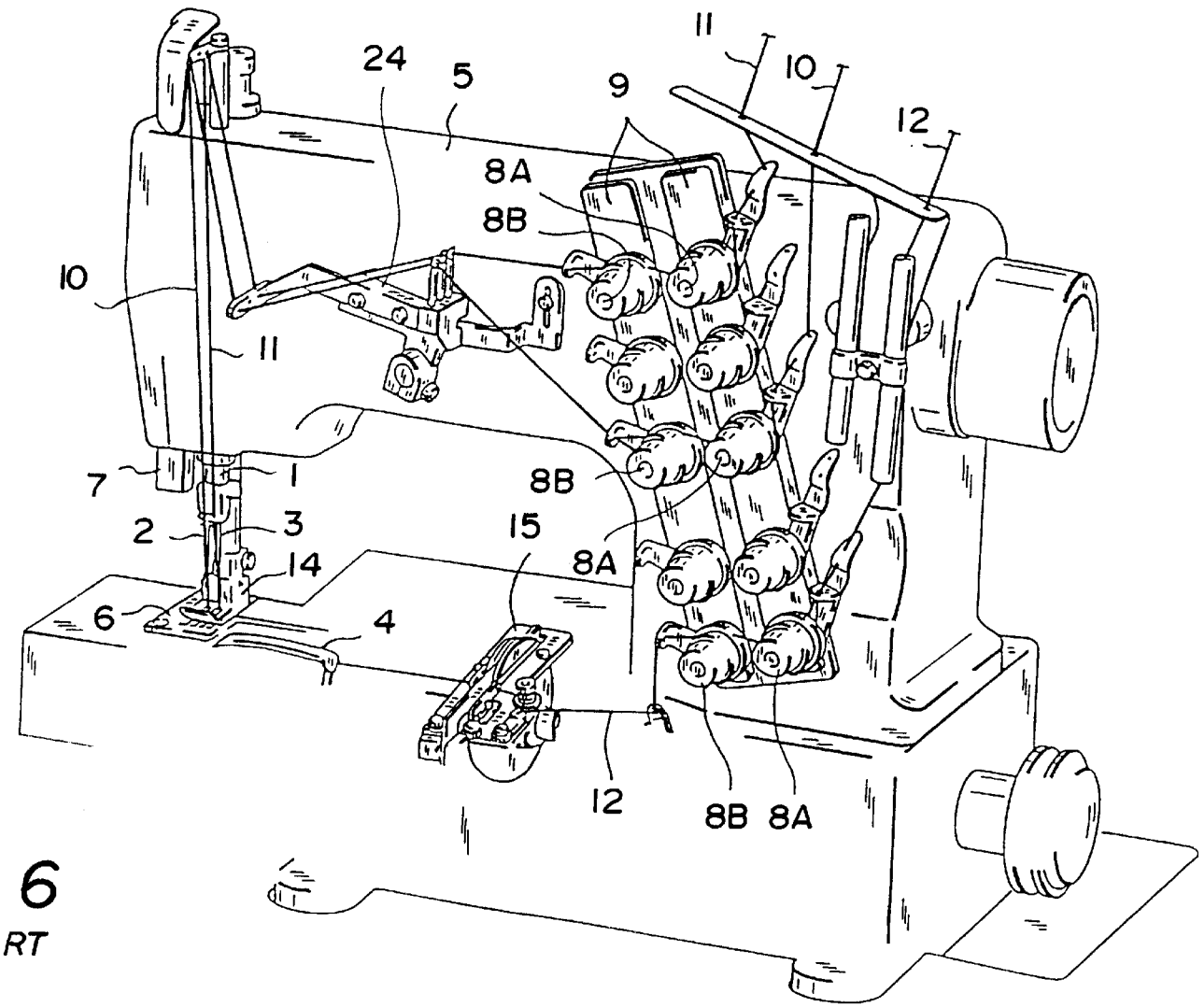
FIG. 6 PRIOR ART
FIG. 6 is a perspective view showing a conventional double chain stitch sewing machine.

FIG. 1 is a perspective view of the double chain stitch sewing machine according to the present invention. This double chain stitch sewing machine basically has the same constituent elements as the conventional double chain stitch sewing machine shown in FIG. 6, and the same constituent elements are identified with the same reference numerals, and a detailed description is omitted.

Figure 2:
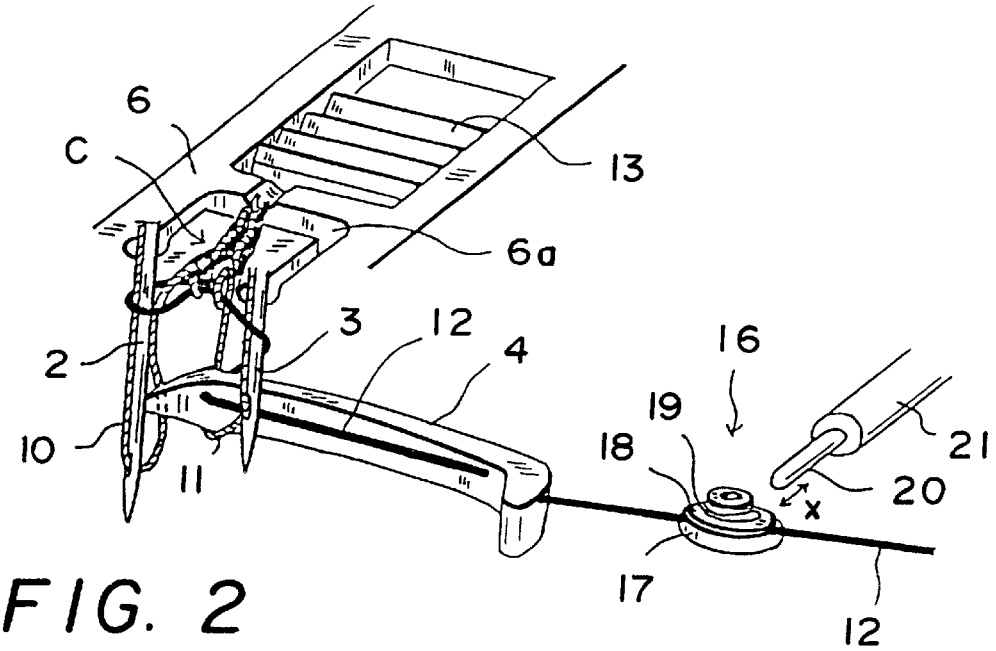
FIG. 2 is a magnified perspective view of an essential view of the same sewing machine.

In the double chain stitch sewing machine 5 shown in FIG. 1, a looper thread tensioning device 16 is disposed in the thread route between the looper 4 and the looper thread take-up device 15. This looper thread tensioning device 16 is designed, as shown in FIG. 2, to control the draw-out amount of a looper thread 12 when forming a thread chain by applying a slight tension of about 5 gf to the looper thread 12 passed between two thread tensioning discs 17, 18 by keeping these two thread tensioning discs 17, 18 in contact with each other elastically through a spring 19. As a releasing device for releasing the pinching action of the looper thread 12 by this looper thread tensioning device 16 when sewing the cloth except when forming a thread chain, a projection 20 is provided so as to move in and out between the two thread tensioning discs 17, 18. The projection 20 is designed to be freely movable reciprocally in the direction of arrow x in FIG. 2 through an air cylinder 21 cooperating with a thread tensioning changeover device 9 provided to changeover the thread tensioning action state by two thread tensioning devices 8A, 8B.

An oscillating type needle guard 22 is provided beneath the two needles 2, 3 disposed parallel right and left to the lower end of a needle bar 1. A thread chain guard 23 for supporting a thread chain C formed by needle threads 10, 11 and looper thread 12 from beneath the rear part of the looper 4 is provided consecutively to this needle guard 22.

In the thus constituted double chain stitch sewing machine 5, the operation is described below.

When sewing a cloth without using a cover thread, the thread tensioning device 8A is set in an active state to control the thread tensioning state by the two thread tensioning devices 8A, 8B so that the tension applied to the right and left needle threads 10, 11 may be strong and the tension applied to the looper thread 12 may be weak, the projection 20 is advanced between the two thread tensioning discs 17, 18 by the looper thread tensioning device 16, and the sewing machine 5 is driven in a state of release of the pinching action on the looper thread 12. Consequently, while feeding the cloth set on the needle plate 6 in the specified direction by the feed dog 13, double chain stitches such as the U.S. Federal Standard stitch type 402, 406 and 407 are formed in the cloth by the needle threads 10, 11 and looper thread 12 passed through the right and left needles 2, 3 and looper 4, respectively.

When nearing the end of sewing by a double chain stitch, the sensor 7 detects the end of the cloth, the thread tensioning changeover device 9 is actuated, and the thread tensioning device 8B is changed over in the active state to control the thread tensioning state by the two thread tensioning devices 8A, 8B so that the tension applied to the left needle thread 10 may be strong and the right needle thread 11 may be weak, and the tension applied to the looper thread 12 may be strong, to thereby be ready for forming a thread chain. In cooperation therewith, moreover, the air cylinder 21 is operated, and the projection 20 retreats from between the two thread tensioning discs 17, 18 in the looper thread tensioning device 16, and the looper thread 12 positioned in the thread route between the looper 4 and looper thread take-up device 15 is pinched between the two thread tensioning discs 17, 18.

Figure 3:
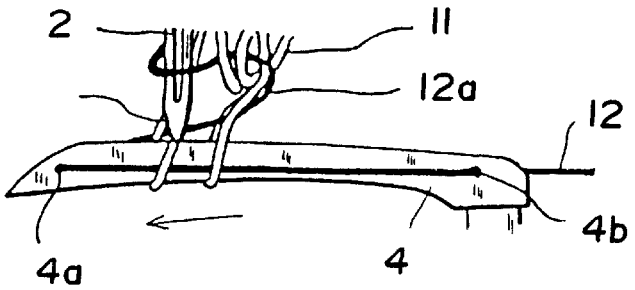
FIG. 3 is a magnified front view of essential parts for explaining the state of thread chain forming action by the same sewing machine.
Figure 8:
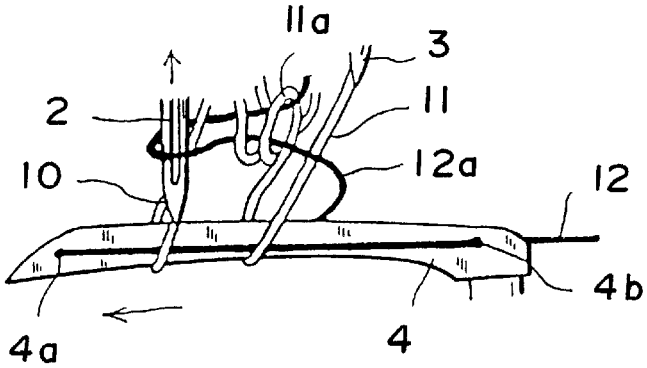
FIG. 8 is a magnified front view of essential parts showing a second state of thread chain forming action by the same conventional double chain stitch sewing machine.

In this state, as the looper 4 advances to the left and the right and the left needles 2, 3 ascend, the looper thread 12 engaged with the right side needle 3 is dislocated from the needle 3, and a temporary sag occurs in the looper thread 12 between the right and left needles 2, 3 as explained in FIG. 8. At this time, however, since the looper thread 12, in which is the loose state by the looper thread take-up device 15 is pinched between the two thread tensioning discs 17, 18 in the looper thread tensioning device 16 as mentioned above, if the looper 4 advances to the left as shown in FIG. 3, the looper thread 12 is not moved, and the draw-out amount is limited. As a result, the temporary sag occurring in the looper thread 12 is absorbed along with the leftward movement of the looper 4, and the right side needle thread 11 is of weak tension and is pulled to the left side needle thread 10 side, so that a tight thread chain C may be formed.

When the looper 4 moves from the left center position to the right, and the needles 2, 3 descend toward the triangle of the threads, the looper thread 12 is pulled back by the looper thread take-up device 15, and therefore its tension is maintained, thereby promoting the movement of the right side needle thread 11 to the left side needle thread 10 side.

Figure 4:
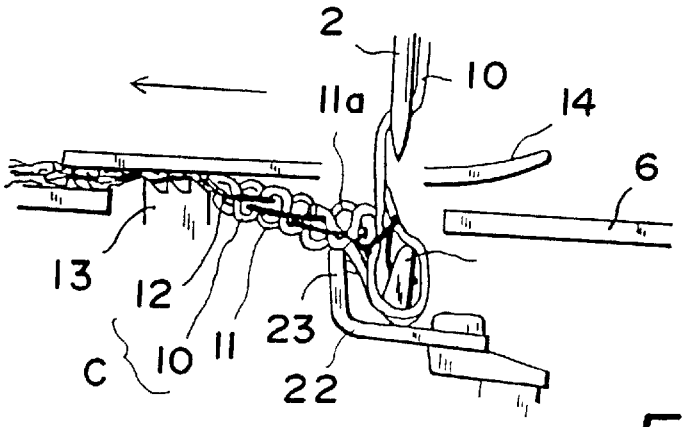
FIG. 4 is a magnified side view of essential parts showing a first state of thread chain receiving action by the same sewing machine.
Figure 5:
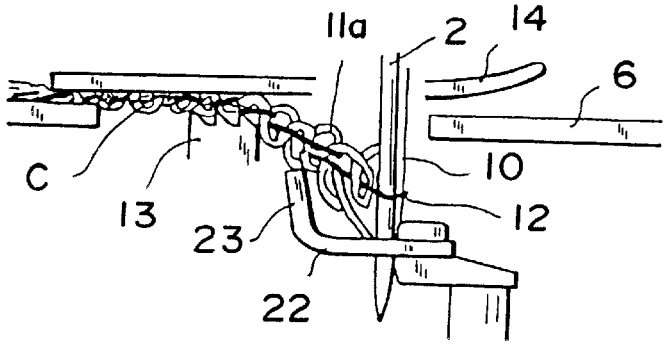
FIG. 5 is a magnified side view of essential parts showing a second state of thread chain receiving action by the same sewing machine.
Figure 7:
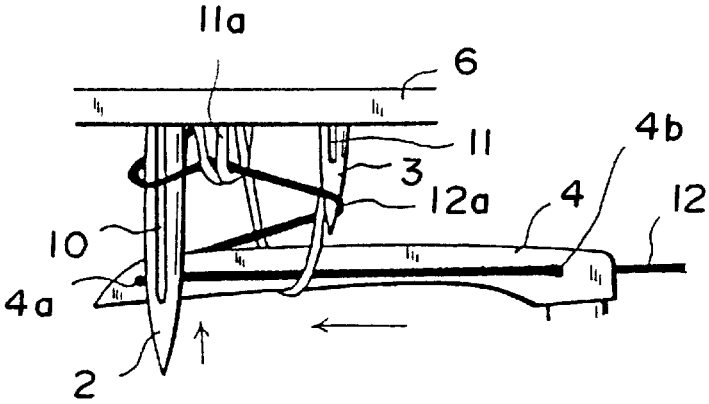
FIG. 7 is a magnified front view of essential parts showing a first state of thread chain forming action by the same conventional double chain stitch sewing machine.

Moreover, as shown in FIG. 4, the looper 4 captures the needle threads 10,11 and when feeding by the feed dog 13 finishes, the needle threads 10, 11 entangled in the looper 4 lightly contact with the thread chain guard 23. When the needles 2, 3 reach the lowest position, as shown in FIG. 5, the loop 11*a* of the right side needle thread 11 slipping out of the looper 4 is supported from beneath by the thread chain guard 23, so that drooping does not occur. Consequently, when the looper 4 captures the needle threads 10, 11, along with an ascent of the needles 2, 3, the loop 11*a* of the right side needle thread 11 one stitch before ascends up to the back side of the needle plate 6, and goes out of the advancing route of the looper 4, and therefore the looper 4 is securely prevented from capturing again the loop 11*a* of the right side needle thread 11, which is known as double capturing, so that breakage or jamming of thread chain may be prevented securely.

The entire disclosure of Japanese Patent Application No. 8-122663 filed on Apr. 19, 1996, including the specification, claims, drawings, and summary is incorporated herein by reference to its entirety.

What is claimed is:

1. A thread control apparatus for a double chain stitch sewing machine comprising:

a needle bar;

a plurality of needles disposed parallel to each other and extending from the lower end of said needle bar;

a looper oscillating laterally relative to said plurality of needles;

two thread tensioning devices for applying different thread tensions to a plurality of needle threads and a looper thread, respectively passed through said plurality of needles and said looper when sewing cloth and when forming a thread chain;

a needle thread take-up device for needle threads and a looper thread take-up device for the looper thread being disposed respectively between said two thread tensioning devices and said plurality of needles and said looper;

sensor for detecting the presence or absence of cloth;

a thread tensioning changeover device for automatically changing over the thread tension applied to the plurality of needle threads and the looper thread by said two thread tensioning devices depending on detecting the presence or absence of cloth by the sensor;

an other looper thread tensioning device disposed in a thread route between said looper and said looper thread take-up device for applying a tension to the looper thread from the thread take-up device side to the looper side; and a releasing device for releasing the looper thread tensioning action by the other looper thread tensioning device when sewing cloth.

2. A thread control apparatus for a double chain stitch sewing machine according to claim 1, wherein said thread tensioning changeover device changes over said two thread tensioning devices to a first thread tensioning device so that the tension applied to the plurality of needle threads may be strong and the tension applied to the looper thread may be weak when sewing cloth, and to a second thread tensioning device so that the tension applied to the left needle thread may be strong, the tension applied to the right needle thread may be weak and the tension applied to the looper thread may be strong when forming a thread chain.

3. A thread control apparatus for a double chain stitch sewing machine of claim 1, wherein the looper thread tensioning device may apply a light tension to the looper thread pinched between two thread tensioning discs by causing these two thread tensioning discs to elastically contact each other, and said releasing device includes an air cylinder, and a projection moved in and out between said two thread tensioning discs by said air cylinder working in cooperation with said thread tensioning changeover device.

4. A thread control apparatus for a double chain stitch sewing machine of claim 1, said apparatus further comprising: a thread chain guard for supporting the thread chain formed by the plurality of needle threads and the looper thread from beneath the rear part of said looper, the thread chain guard being formed consecutively to a needle guard provided beneath said plurality of needles.

5. A thread control apparatus for a double chain stitch sewing machine of claim 2, said apparatus further comprising: a thread chain guard for supporting the thread chain formed by the plurality of needle threads and the looper thread from beneath the rear part of said looper, the thread chain guard being formed consecutively to a needle guard provided beneath said plurality of needles.

6. A thread control apparatus for a double chain stitch sewing machine of claim 3, said apparatus further comprising: a thread chain guard for supporting the thread chain formed by the plurality of needle threads and the looper thread from beneath the rear part of said looper, the thread chain guard being formed consecutively to a needle guard provided beneath said plurality of needles.

* * * * *

UNITED STATES PATENT AND TRADEMARK OFFICE

CERTIFICATE OF CORRECTION

PATENT NO. : 5,816,175

DATED : October 6, 1998

INVENTOR(S) : Masashi Teramoto

It is certified that error appears in the above-indentified patent and that said Letters Patent is hereby corrected as shown below:

Claim 1, column 6, line 11, before "sensor" --a-- should be inserted.

Signed and Sealed this

Thirteenth Day of April, 1999

*Attest:*

Q. TODD DICKINSON

*Attesting Officer*

*Acting Commissioner of Patents and Trademarks*